US006805426B2

(12) United States Patent
Kokubo et al.

(10) Patent No.: US 6,805,426 B2
(45) Date of Patent: Oct. 19, 2004

(54) MOTOR CONTROL METHOD AND APPARATUS

(75) Inventors: Masatoshi Kokubo, Aichi-ken (JP); Shigeki Akiyama, Ichinomiya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 8 days.

(21) Appl. No.: 10/320,640

(22) Filed: Dec. 17, 2002

(65) Prior Publication Data

US 2003/0117448 A1 Jun. 26, 2003

(30) Foreign Application Priority Data

Dec. 20, 2001 (JP) ..... 2001-387759

(51) Int. Cl.[7] ..... B41J 29/3934; B41J 23/00; B41J 29/38

(52) U.S. Cl. ..... 347/19; 347/37; 347/14

(58) Field of Search ..... 347/19, 37, 14

(56) References Cited

U.S. PATENT DOCUMENTS 6,081,091 A * 6/2000 Mitchell et al. ..... 318/685

6,619,778 B2 * 9/2003 Igarashi ..... 347/19

FOREIGN PATENT DOCUMENTS

| | | |
|---|---|---|
| EP | 0 805 383 A | 5/1997 |
| EP | 1 031 429 A | 8/2000 |
| EP | 1 072 425 A | 1/2001 |

* cited by examiner

*Primary Examiner*—Stephen D. Meier
*Assistant Examiner*—Alfred Dudding
(74) *Attorney, Agent, or Firm*—Oliff & Berridge PLC

(57) ABSTRACT

Method and apparatus for controlling an operating speed of a motor provided to move an object body such as a carriage carrying a printing head in a printer, wherein a control-signal generating portion generates a control signal for controlling the speed of the motor such that a moving speed of the object body represented by a speed signal generated by a speed-signal generating portion coincides with a target value, and the control signal is generated on the basis of proportional and integral control values obtained on the basis of an output of a filter operable to remove from the speed signal a component having a frequency not lower than a predetermined threshold or at least a component corresponding to a cogging frequency of the motor, and a differential control value obtained on the basis of the output of the filter or the speed signal.

24 Claims, 9 Drawing Sheets

MOTOR CONTROL METHOD AND APPARATUS

The present application is based on Japanese Patent Application No. 2001-387759 filed Dec. 20, 2001, the content of which is incorporated herein by reference.

BACKGROUND OF THE INVENTION

1. Field of the Invention

The present invention relates to a method and apparatus for controlling an operating speed of a motor provided to move an object body, such that a moving speed of the object body coincides with a predetermined target value.

2. Discussion of Related Art

In a conventional printer (e.g., an ink-jet printer) of a type wherein a printing head performs a printing operation on a sheet of paper during a movement of the printing head, an electric motor (hereinafter referred as "CR motor") is used to drive a carriage which carries the printing head. To assure printing actions exactly as predetermined printing positions, a moving speed of the carriage is required to be held constant within a predetermined range or distance of printing. To this end, the moving speed of the carriage is detected by using an encoder, and an electric current to be applied to the CR motor is controlled according to a suitable control algorithm such as a PID algorithm, such that the detected moving speed coincides with a predetermined target value, so that a torque generated by the motor, namely, a drive force required to move the carriage is controlled.

Generally, a direct current (DC) motor is used as the CR motor. It is known that the DC motor has a variation in torque, or so-called "cogging" of torque, which takes place due to a variation in a magnetic attracting force produced between a stator and a rotor of the motor.

This cogging of torque disturbs a predetermined linear relationship between the drive current and the torque of the CR motor. Accordingly, a PID or other closed-loop control of the drive current of the CR motor having the cogging torque has a risk that the torque variation (speed variation) at the cogging frequency is undesirably amplified, resulting in considerable deterioration in the stability of the operating speed of the CR motor.

Described in detail, even when the drive current is adequately controlled so as to control the motor speed to the target value, the detected moving speed of the carriage has an error with respect to the target value at angular positions of the motor at which the torque cogging takes place. Since the drive current is conventionally controlled so as to eliminate this error, the operating speed of the motor cannot be controlled with a high degree of stability.

SUMMARY OF THE INVENTION

It is therefore an object of the present invention to control an electric motor provided to move an object body, such that the operating speed of the motor is controlled with high stability, to permit a printing operation with high image resolution, for example. This object may be achieved according to any one of the following modes of the present invention in the form of a motor control method or a motor control apparatus, each of which is numbered like the appended claims and depends from the other mode or modes, where appropriate, for easier understanding of technical features disclosed in the present application and possible combinations of those features. However, it is to be understood that the invention is not limited to those technical features or combinations thereof, and that any one of a plurality of technical features described below with respect to any one mode of the invention may be a subject matter of the present invention, without the other technical feature or features being combined with that one technical feature.

(1) A method of controlling an operating speed of a motor provided to move an object body such that a moving speed of the object body coincides with a predetermined target value, comprising the steps of:

obtaining a speed control error between the target value and a speed value represented by a filtered speed signal obtained by removing a component having a frequency not lower than a predetermined threshold value, from an original speed signal corresponding to the moving speed of the object body; and controlling the operating speed of the motor according to a control signal generated on the basis of results of a proportional calculating operation and an integral calculating operation of the speed control error, and a result of a differential calculating operation of the original speed signal.

In the motor control method according to the above mode (1) of this invention, the component (hereinafter referred to as "specific-frequency component") which has a frequency not lower than the predetermined threshold value and which is included in the original speed signal is removed to obtain the filtered speed signal which is used to obtain the speed control error, which is used for the proportional and integral calculating operations. Accordingly, a periodic variation in the moving speed of the object body is not amplified due to the specific-frequency component, by a feedback control of the operating speed of the motor according to the control signal. On the other hand, the differential calculating operation is performed with respect to the original speed signal which includes the specific-frequency component.

Accordingly, the present motor control method not only prevents deterioration of stability of the moving speed of the object body due to the specific-frequency component included in the original speed signal, but also effectively minimizes minute variations in the moving speed of the object body due to the component having a frequency higher than the predetermined threshold value.

(2) A method according to the above mode (1), wherein the predetermined threshold value is not higher than a cogging frequency of the motor.

The predetermined threshold value of the frequency is preferably selected to be equal to or lower than the cogging frequency of the motor, where the motor is a direct-current (DC) motor, a stepping motor or any other motor which inevitably suffers from cogging of its torque.

(3) A method according to the above mode (1) or (2), wherein the object body is a carriage which carries a printing head.

Where the object body is a carriage carrying a printing head, the present motor control method permits a significant improvement in the quality of an image printed by the printing head.

In a printer, vibrations of various elements of the printer as well as the cogging torque of the motor influence the speed signal. In particular, minute variations in the moving speed (i.e., printing positions) of the carriage generated due to a signal component having a high frequency have a considerable adverse influence on the resolution of the printed image. These minute variations can be minimized by the differential calculating operation which is performed with respect to the original speed signal including such a high frequency component.

(4) A method according to any one of the above modes (1)–(3), wherein the control signal is generated by subtracting the result of the differential calculating operation from a sum of the results of the proportional and integral calculating operations.

(5) A method according to any one of the above modes (1)–(4), wherein the operating speed of the motor is controlled according to the control signal until the object body has reached a predetermined deceleration-start position at which deceleration of the object body is initiated.

(6) A method according to any one of the above modes (1)–(4), wherein the operating speed of the motor is controlled according to the control signal while the object body is moved between a predetermined acceleration-end position and a predetermined deceleration-start position at which acceleration and deceleration of the object body are terminated and initiated, respectively.

(7) A method according to any one of the above modes (1)–(6), wherein the predetermined threshold value is changed depending upon the target value of the operating speed of the object body.

(8) A motor control apparatus for controlling an operating speed of a motor provided to move an object body, the motor control apparatus including a speed-signal generating portion operable to generate a speed signal corresponding to a moving speed of the object body, and a control-signal generating portion operable to generate a control signal for controlling the operating speed of the motor such that the moving speed of the object body represented by the speed signal coincides with a predetermined target value, the control-signal generating portion comprising a filter operable to remove from the speed signal a component which has a frequency not lower than a predetermined threshold value;

an error calculator operable to obtain a speed control error between a speed represented by an output of the filter and the target value;

a proportional operator operable to obtain a proportional control value proportional to the speed control error;

an integral operator operable to obtain an integral control value proportional to an integral of the speed control error;

a differential operator operable to obtain a differential control value proportional to a derivative of the speed signal; and an arithmetic operator operable to generate the control signal on the basis of the proportional, integral and differential control values.

In the motor control apparatus according to the above mode (8) of this invention, the speed-signal generating portion is arranged to generate a speed signal corresponding to the moving speed of the object body, and the control-signal generating portion is arranged to generate a control signal for controlling the operating speed of the motor such that the moving speed of the object body represented by the speed signal coincides with a predetermined target value.

Described more specifically, the control-signal generating portion is arranged such that its filter removes from the speed signal a component which has a frequency not lower than a predetermined threshold value, and the error calculator obtains the speed control error between the speed represented by the output of the filter and the target value. The proportional operator obtains the proportional control value proportional to the speed control error, and the integral operator obtains the integral control value proportional to an integral of the speed control error, while the differential operator obtains the differential control value proportional to a derivative of the speed signal. On the basis of those proportional, integral and differential control values, the arithmetic operator generates the control signal for controlling the operating speed of the motor.

Thus, the present motor control apparatus is constructed to practice the motor control method according to the above mode (1), and has substantially the same advantages as the motor control method.

(9) A motor control apparatus according to the above mode (8), wherein the predetermined threshold value is not higher than a cogging frequency of the motor.

The predetermined threshold value of the frequency is preferably selected to be equal to the cogging frequency of the motor, where the motor is a direct-current (DC) motor, a stepping motor or any other motor which inevitably suffers from cogging of its torque, as described above with respect to the above mode (2).

(10) A motor control apparatus according to the above mode (8) or (9), wherein the object body is a carriage which carries a printing head.

Where the object body is a carriage carrying a printing head, the present motor control apparatus permits a significant improvement in the quality of an image printed by the printing head, as described above with respect to the motor control method according to the above mode (3).

(11) A motor control apparatus according to any one of the above modes (8)–(10), wherein the predetermined threshold value of the filter is variable depending upon the target value of the moving speed of the object body.

Where the predetermined threshold value of the frequency varies with the operating speed of the motor, like the cogging frequency of the motor varying with the motor speed, the component having the predetermined threshold must be reduced or suppressed while the object body is moving at the target speed. To this end, it is desirable to change the threshold frequency (cutoff frequency) depending upon the target speed.

(12) A motor control apparatus according to any one of the above modes (8)–(11), further including:

a position detector operable to detect a position of the object body; and signal switching means for applying the output of the filter to the error calculator while the position of the object body detected by the position detector is within a predetermined constant-speed region in which the moving speed of the object body is held constant at the target value, and for applying to the error calculator the speed signal generated by the speed-signal generating portion, while the position of the object body is within one of accelerating and decelerating regions in which the object body is accelerated and decelerated, respectively.

In the motor control apparatus according to the above mode (12), the speed control error used for the proportional and integral control values is obtained on the basis of the speed signal generated by the speed-signal generating portion, while the object body is moving within the accelerating or decelerating region, and on the basis of the output of the filter which does not include the specific-frequency component, while the object body is moving within the constant-speed region. In this arrangement, a change in the moving speed of the object body is more positively fed back in the accelerating and decelerating regions than in the constant-speed region.

Accordingly, the motor control apparatus according to the above mode (12) is effective to prevent an excessively high rate of change of the moving speed in the accelerating and decelerating regions, so that it is possible to prevent damping in the accelerating period, or an overshoot of the moving speed of the object body upon its movement from the accelerating region into the constant-speed region, assuring a further improvement in the stability of movement of the object body.

(13) A motor control apparatus according to any one of the above modes (8)–(11), wherein the arithmetic operator receives the output of the filter until the object has reached a predetermined deceleration-start position at which deceleration of the object body is initiated.

(14) A motor control apparatus according to any one of the above modes (8)–(13), wherein the arithmetic operator generates the control signal by subtracting the differential control value from a sum of the proportional and integral control values.

(15) A motor control apparatus according to any one of the above modes (8)–(14), further comprising a register which stores data indicative of the predetermined threshold value and which is connected to the filter.

(16) A method of controlling an operating speed of a motor provided to move a carriage carrying a printing head, such that a moving speed of the carriage coincides with a predetermined target value, comprising the steps of:

obtaining a speed control error between the target value and a speed value represented by a filtered speed signal obtained by removing at least a component corresponding to a cogging frequency of the motor, from an original speed signal corresponding to the moving speed of the carriage; and controlling the operating speed of the motor according to a control signal generated on the basis of results of a proportional calculating operation, an integral calculating operation and a differential calculating operation of the speed control error.

In the motor control method according to the above mode (16), the speed control error for which the proportional, integral and differential calculating operations are to be performed is obtained on the basis of the filtered speed signal obtained by removing at least the component (specific-frequency component) corresponding to the cogging frequency of the motor, from the original speed signal corresponding to the moving speed of the carriage. Namely, the filtered speed signal includes a component having a frequency higher than the cogging frequency.

In the present motor control method, a periodic variation in the moving speed of the carriage is not amplified due to the specific-frequency component corresponding to the cogging frequency, by a feedback control of the operating speed of the motor according to the control signal. Thus, the present motor control method prevents deterioration of stability of the moving speed of the carriage due to the cogging torque of the motor. In addition, the present method is effective to minimize minute variations in the moving speed of the carriage which would take place due to a signal component having a frequency higher than the cogging frequency. Accordingly, the present method permits a significant improvement in the quality of the image printed by the printing head, as described above with respect to the method according to the above mode (3).

(17) A method according to the above mode (16), wherein the component corresponding to the cogging frequency of the motor is a frequency component of the original speed signal, which frequency component is within a predetermined frequency band including the cogging frequency.

(18) A method according to the above mode (16) or (17), wherein the control signal is generated by summing the results of the proportional, integral and differential calculating operations.

(19) A method according to any one of the above modes (16)–(18), wherein the operating speed of the motor is controlled according to the control signal until the carriage has reached a predetermined deceleration-start position at which deceleration of the carriage is initiated.

(20) A method according to any one of the above modes (16)–(19), wherein the predetermined threshold value is changed depending upon the target value of the operating speed of the carriage.

(21) A motor control apparatus for controlling an operating speed of a motor provided to move a carriage carrying a printing head, the motor control apparatus including a speed-signal generating portion operable to generate a speed signal corresponding to a moving speed of the carriage, and a control-signal generating portion operable to generate a control signal for controlling the operating speed of the motor such that the moving speed of the carriage represented by the speed signal coincides with a predetermined target value, the control-signal generating portion comprising:

a filter operable to remove from the speed signal at least a component corresponding to a cogging frequency of the motor;

an error calculator operable to obtain a speed control error between a speed represented by an output of the filter and the target value;

a proportional operator operable to obtain a proportional control value proportional to the speed control error;

an integral operator operable to obtain an integral control value proportional to an integral of the speed control error;

a differential operator operable to obtain a differential control value proportional to a derivative of the speed control error; and an arithmetic operator operable to generate the control signal on the basis of the proportional, integral and differential control values.

In the motor control apparatus according to the above mode (21) of the present invention, the speed-signal generating portion generates a speed signal corresponding to the moving speed of the carriage, and the control-signal generating portion generates a control signal for controlling the operating speed of the motor such that the moving speed of the carriage represented by the speed signal coincides with a predetermined target value.

Described more specifically, the control-signal generating portion is arranged such that the filter removes from the speed signal at least a component corresponding to the cogging frequency of the motor, and the error calculator obtains the speed control error between a speed represented by an output of the filter and the target value. Further, the proportional operator obtains the proportional control value proportional to the speed control error, and the integral operator obtains the integral control value proportional to an integral of the speed control error, while the differential operator obtains the differential control value proportional to a derivative of the speed control error. On the basis of these proportional, integral and differential control values, the arithmetic operator generates the control signal for controlling the operating speed of the motor.

Thus, the present motor control apparatus is constructed to practice the motor control method according to the above mode (16), and has substantially the same advantages as this motor control method.

(22) A motor control apparatus according to the above mode (21), wherein the arithmetic operator receives the output of the filter until the object has reached a predetermined deceleration-start position at which deceleration of the object body is initiated.

(23) A motor control apparatus according to the above mode (21) or (22), wherein the arithmetic operator generates the control signal by summing the proportional, integral and differential control values.

(24) A motor control apparatus according to any one of the above modes (21)–(23), further comprising a register which stores data indicative of the predetermined threshold value and which is connected to the filter.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which.

DETAILED DESCRIPTION OF THE PREFERRED EMBODIMENTS

Figure 1:
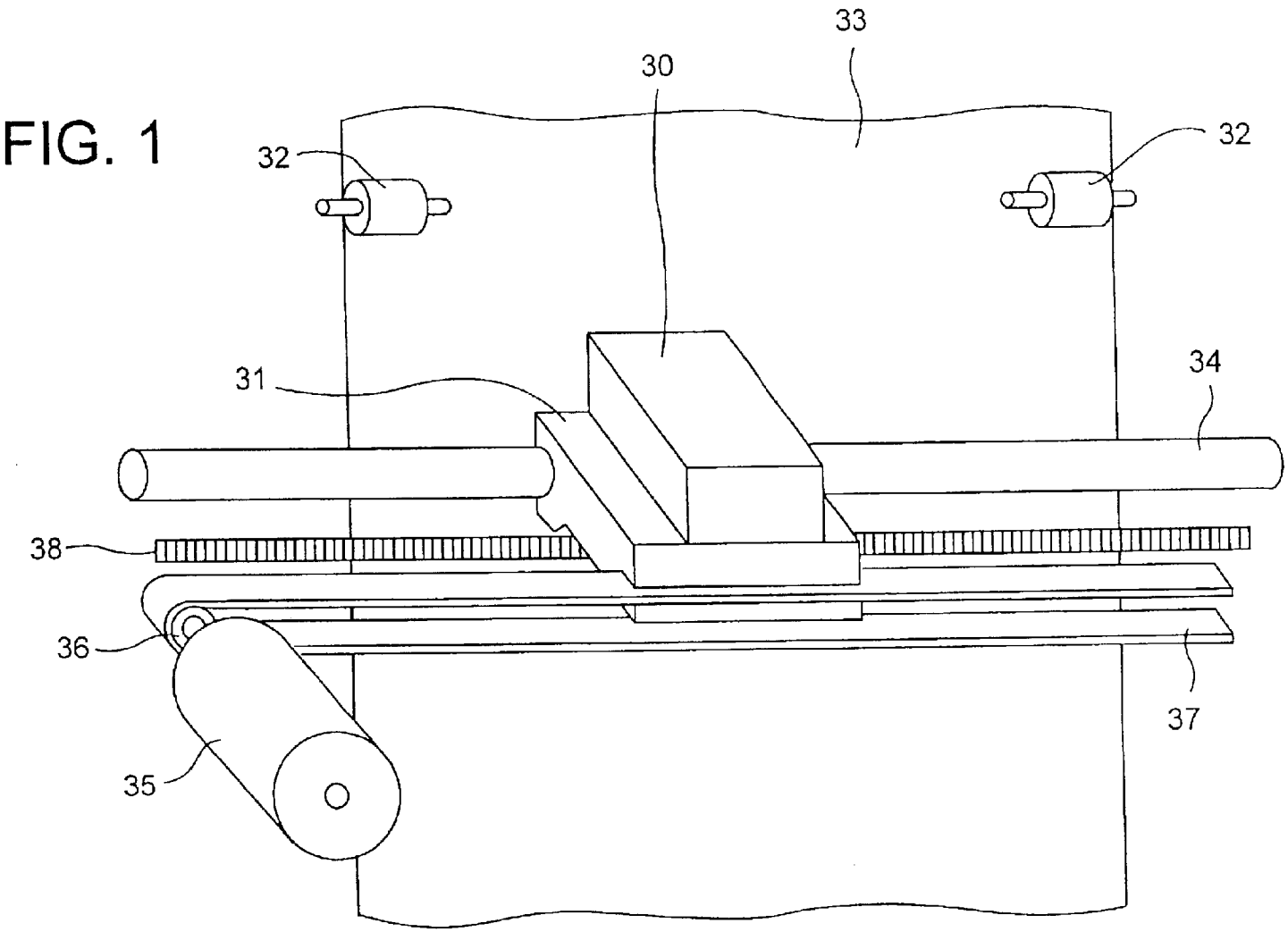
FIG. 1 is a schematic view showing a carriage drive mechanism in an ink-jet printer.

There will be described some preferred embodiments of the present invention, by reference to the accompanying drawings. Referring first to FIG. 1, there is shown a carriage drive mechanism in an ink-jet printer (hereinafter referred to simply as "printer") incorporating a carriage motor control apparatus constructed according to one embodiment of the invention.

As shown in FIG. 1, the printer has a sheet feeding mechanism which includes presser rolls 32 and which is arranged to feed a sheet of paper 33 in a predetermined feeding direction. The printer further has a guide rod 34 disposed so as to extend in a width direction of the paper sheet 33, which is perpendicular to the above-indicated feeding direction. The printer also has a printing head 30 mounted on a carriage 31 which is slidably supported and guided by the guide rod 34. The printing head 30 has nozzles for injecting an ink onto the paper sheet 33. The carriage 31 is connected to an endless belt 37 extending in parallel with the guide rod 34, and is held in engagement with a driving pulley 36 and a driven or idler pulley (not shown). The driving pulley 36 is driven by a carriage drive motor 35 (hereinafter referred to as "CR motor 35") located at one end of the guide rod 34, while the idler pulley is located at the other end of the guide rod 34.

In the carriage drive mechanism constructed as described above, the carriage 31 is arranged to be reciprocated in the width direction of the paper sheet 33 parallel to the guide rod 34, with a drive force which is produced by the CR motor 35 and which is transmitted to the carriage 31 through the endless belt 37.

Under the guide rod 34, there is disposed a timing scale 38 extending along the guide rod 34. The timing scale 38 has a succession of slits each of which has a predetermined width and which are formed such that the slits are equally spaced apart from each other by a predetermined distance (for example, 1/150 inch or about 0.17 mm) in the direction of movement of the carriage 31. On the underside of the carriage 31, there is disposed a detecting portion in the form of a photo-interrupter including one light-emitting element and at least two light-receiving or photosensitive elements, which are arranged such that each light-emitting element is opposed to the at least two light-receiving elements, with the timing scale 38 interposed therebetween. This detecting portion cooperates with the timing scale 38 to constitute a linear encoder 39 (shown in FIG. 4).

Figure 2:
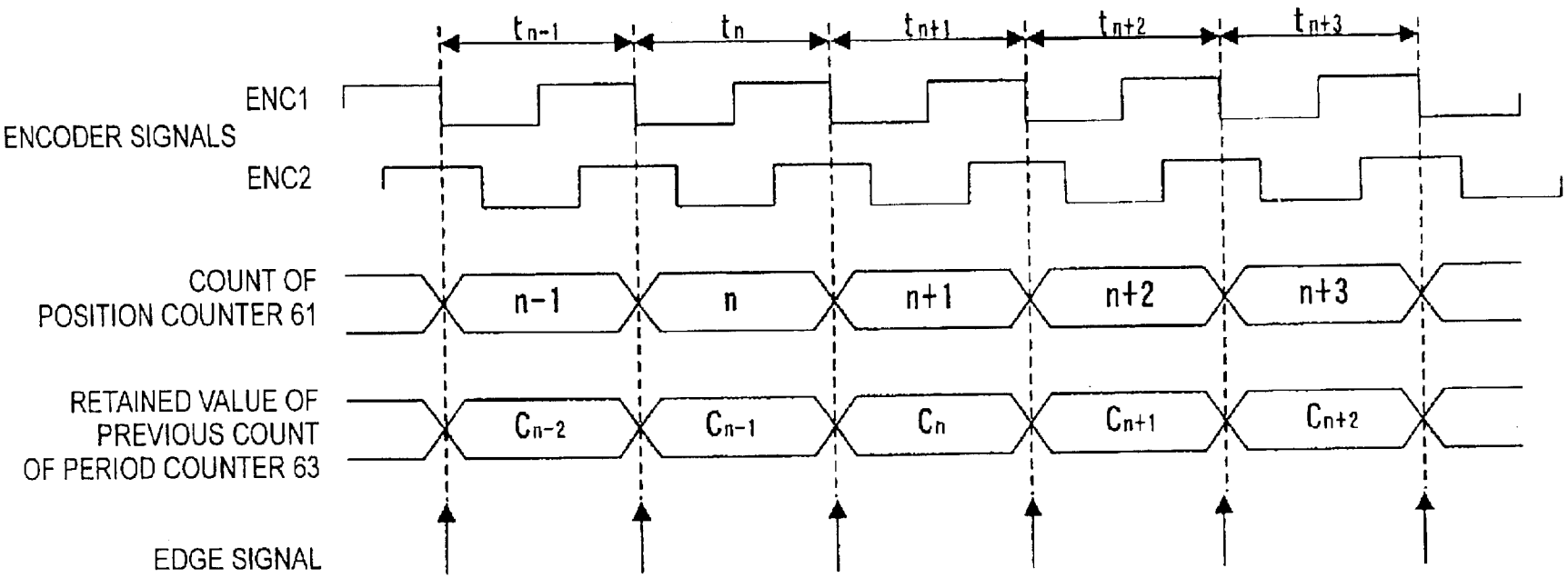
FIG. 2 is a timing chart for explaining operations of some portions of a carriage motor control apparatus to control an electric motor used to drive a carriage of the ink-jet printer.

The detecting portion of the linear encoder 39 generates two kinds of encoder signals ENC1 and ENC2 which have a phase difference of about ¼ of the period, as indicated in FIG. 2. When the carriage 31 is moved in a forward direction (right direction as seen in FIG. 1) from the home position (leftmost position as seen in FIG. 1) toward the idler pulley, the phase of the first encoder signal ENC1 is advanced by about ¼ of the period with respect to the second encoder signal ENC2. When the carriage 31 is moved in a reverse direction from the idler pulley toward the home position, the phase of the first encoder signal ENC1 is retarded by about ¼ of the period with respect to the second encoder signal ENC2.

Figure 3:
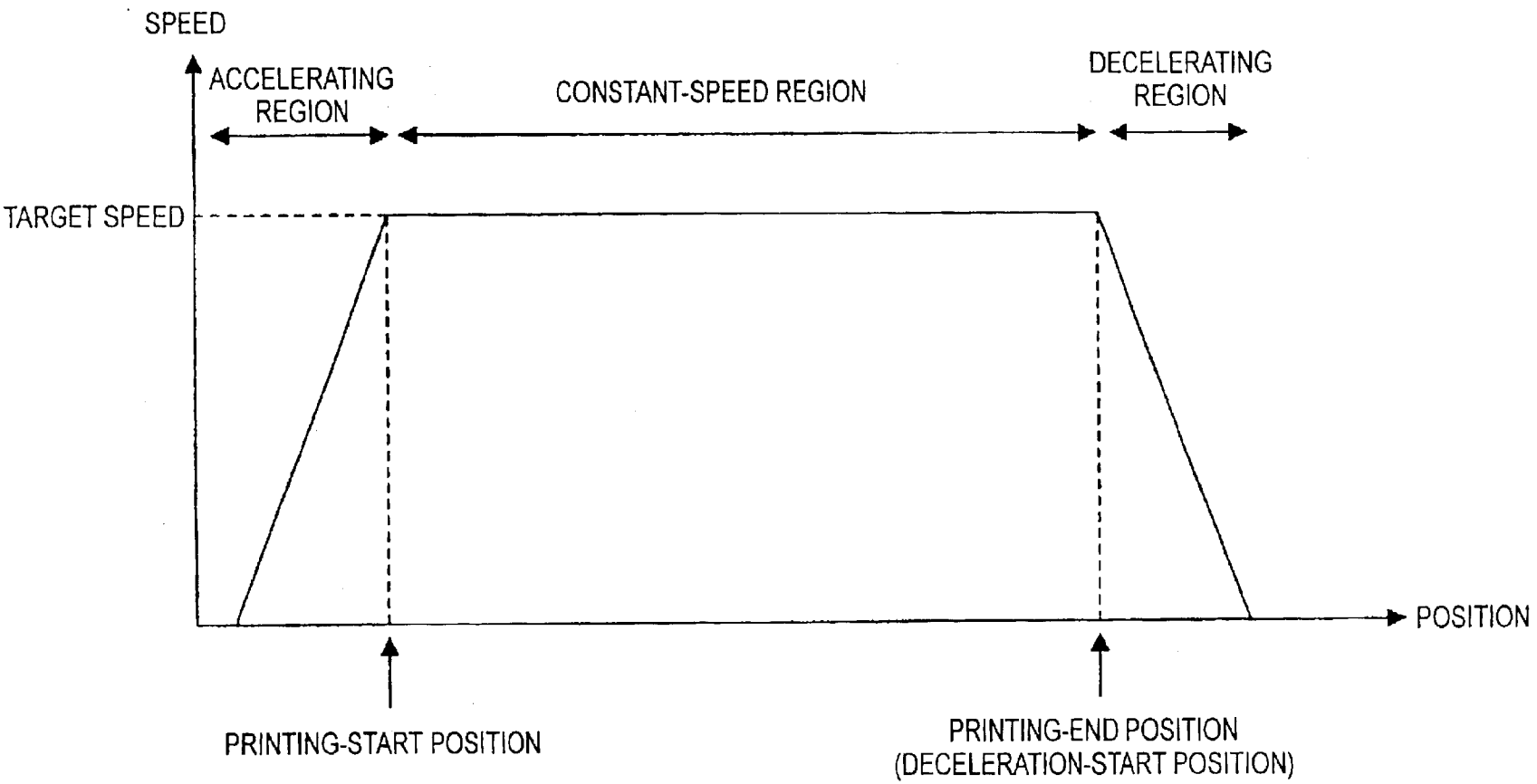
FIG. 3 PRIOR ART
FIG. 3 is a view schematically illustrating a manner in which a movement of the carriage is controlled.

The graph of FIG. 3 indicates a change in the moving speed of the carriage 31 in relation to its position in the moving direction.

While the printer is not in a printing operation, the carriage 31 is located at the home position set in the vicinity of the above-indicated one end of the guide rod 34 on the side of the driving pulley 36, or located at a position at which the last printing operation was terminated. From one of these positions (hereinafter collectively referred to as "zero position"), a movement of the carriage 31 is initiated when a printing operation (next printing operation) is initiated. As indicated in FIG. 3, the carriage 31 is initially accelerated during a period of movement from the zero position to a predetermined printing-start position, such that the moving speed of the carriage 31 is increased to a predetermined desired or target value when the carriage 31 reaches the printing-start position. During a subsequent movement from the printing-start position to a predetermined printing-end position, the moving speed is held constant at the predetermined target speed. After the carriage 31 has reached the printing-end position, the carriage 31 is decelerated until it is brought to a stop. In the following description, a region between the zero position and the printing-start position, a region between the printing-start position (acceleration-end position) and the printing-end position (deceleration-start position), and a region between the printing-end position and the stop position are referred to as an accelerating region, a constant-speed region and a decelerating region, respectively.

<First Embodiment>

Figure 4:
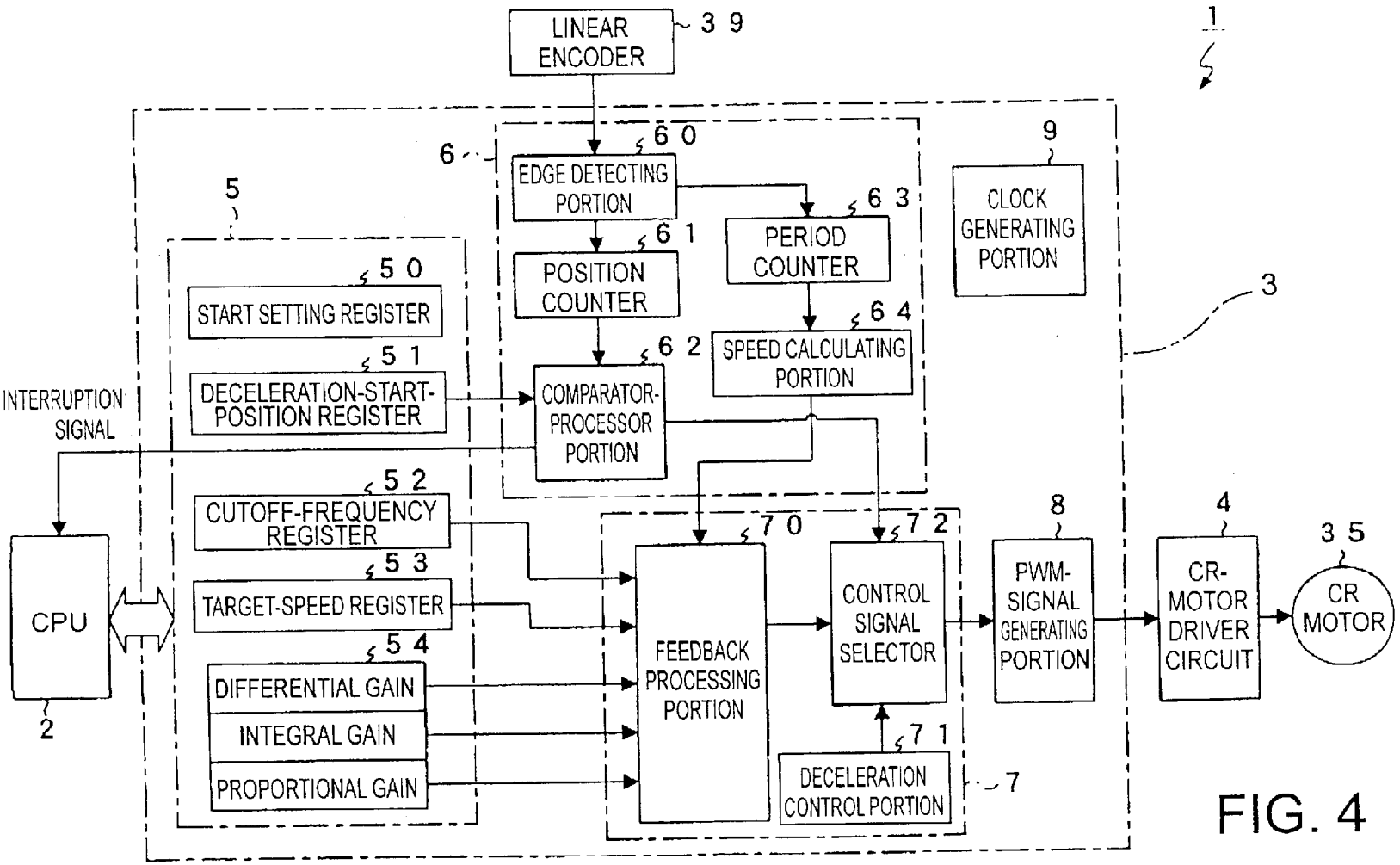
FIG. 4 is a block diagram showing an arrangement of the carriage motor control apparatus constructed according to a first embodiment of this invention.

The block diagram of FIG. 4 shows the carriage motor control apparatus according to a first embodiment, which is generally indicated at 1. The carriage motor control apparatus 1 is arranged to control the CR motor 35 on the basis of the encoder signals ENC1 and ENC2 generated by the linear encoder 39, for thereby controlling the moving speed of the carriage 31.

As shown in FIG. 4, the carriage motor control apparatus 1 consists of a CPU (central processing unit) 2, an ASIC (Application Specific Integrated Circuit) 3, a CR-motor driver circuit 4, and the above-described linear encoder 39. The CPU 2 controls the printer in a centralized or coordinated manner, and the ASIC 3 generates a PWM signal for controlling speed and direction of operation of the CR motor 35. The CR-motor driver circuit 4 has a H-bridge circuit incorporating four FETs each of which is turned on and off according to the PWM signal generated by the ASIC 3, to control the CR motor 35.

The ASIC 3 incorporates a register array 5, a carriage detecting portion 6, a motor control portion 7, a PWM-signal generating portion 8 and a clock generating portion 9. The register array 5 is arranged to store various parameters used for controlling the CR motor 35. The carriage detecting portion 6 is arranged to calculate the position and moving speed of the carriage 31 on the basis of the encoder signals ENC1, ENC2 received from the linear encoder 39. The motor control portion 7 is arranged to control the operating speed of the CR motor 35 on the basis of data received from the carriage detecting portion 6. The PWM-signal generating portion 8 is arranged to generate the PWM signal having a duty ratio determined by a motor control signal generated by the motor control portion 7. The clock generating portion 9 is arranged to generate a clock signal having a period which is sufficiently shorter than that of the encoder signals ENC1, ENC2. The clock signal is fed to various portions of the ASIC 3.

The register array 5 includes: a start setting register 50 for starting the CR motor 35; a deceleration-start-position register 51 for setting the deceleration-start position (printing-end position) at which the deceleration of the carriage 31 is initiated; a cutoff-frequency register 52 for setting a cutoff frequency (specific threshold frequency value) of a low-pass filter (LPF) 11 which will be described; a target-speed register 53 for setting the target speed of movement of the carriage 31; and a gain register 54 for setting a differential gain, an integral gain and a proportional gain, which are used for feedback calculating operations to control the operating speed (torque) of the CR motor 35.

The carriage detecting portion 6 includes an edge detecting portion 60 operable to generate an edge signal indicative of the beginning or end of each period of the first encoder signal ENC1, and to detect the operating direction of the CR motor 35, on the basis of the encoder signals ENC1 and ENC2. In the present embodiment, the edge detecting portion 60 detects the edge of the first encoder signal ENC1 while the second encoder signal ENC2 has a high level. The operating direction of the CR motor 35 is detected to be the forward direction when the detected edge of the first encoder signal ENC1 represents a fall of the signal, and to be the reverse direction when the detected edge represents a rise of the signal. The carriage detecting portion 6 further includes a position counter 61 which is arranged to count the edge signals generated by the edge detecting portion 60. As indicated in FIG. 2, the position counter 61 counts up the generated edge signals in the forward direction, when the operating direction of the CR motor 35 detected by the edge detecting portion 60 corresponds to the forward moving direction of the carriage 31, and counts down the edge signals in the reverse direction when the detected operating direction of the CR motor 35 corresponds to the reverse moving direction of the carriage 31. Thus, the count of the position counter 61 indicates the position of the carriage 31 with respect to the home position, that is, the position of the slit of the timing scale 38 at which the carriage 31 is presently located. For example, the count of the position counter 61 is used to determine whether the carriage 31 is located at the deceleration-start position set in the deceleration-start-position register 51, as described below.

The carriage detecting portion 6 further includes a comparator-processor portion 62 operable to compare the count value "n" of the position counter 61 with a value set in the deceleration-start-position register 51, to determine whether the carriage 31 has been moved to the deceleration-start position, and generate a control switching signal and apply an interruption signal to the CPU 2 when the comparator-processor portion 62 determines that the carriage 31 has reached the deceleration-start position. The carriage detecting portion 6 further includes a period counter 63 operable to detect a period of the edge signals generated by the edge detecting portion 60, by counting the number of the clock signals generated by the clock generating portion 9. The carriage detecting portion 6 also includes a speed calculating portion 64 operable to calculate the moving speed of the carriage 31, on the basis of the spacing distance (1/150 inch) of the slits of the timing scale 38 and a time $t_{n-1}$ ($=C_{n-1}\times$clocking period) determined by a retained value $C_{n-1}$ (indicated in FIG. 2) of the count of the period counter 63 obtained in the previous period of the first encoder signal ENC1.

The motor control portion 7 includes a feedback processing portion 70 operable on the basis of the values set in the cutoff-frequency register 52, target-speed register 53 and gain register 54, to generate a speed control signal for controlling the operating speed of the CR motor 35 such that the moving speed of the carriage 31 calculated by the speed calculating portion 64 coincides with the target speed set in the target-speed register 53. The motor control portion 7 further includes a deceleration control portion 71 operable to generate a deceleration control signal for decelerating the CR motor 35, and a control signal selector 72 operable to supply the PWM-signal generating portion 8 with a motor control signal. Described in detail, the control signal selector 72 supplies the PWM-signal generating portion 8 with the speed control signal generated by the feedback processing portion 70, until the control signal selector 72 receives the control switching signal from the comparator-processor portion 62, and the deceleration control signal generated by the deceleration control portion 71, after the control signal selector 72 receives the control switching signal.

Figure 5:
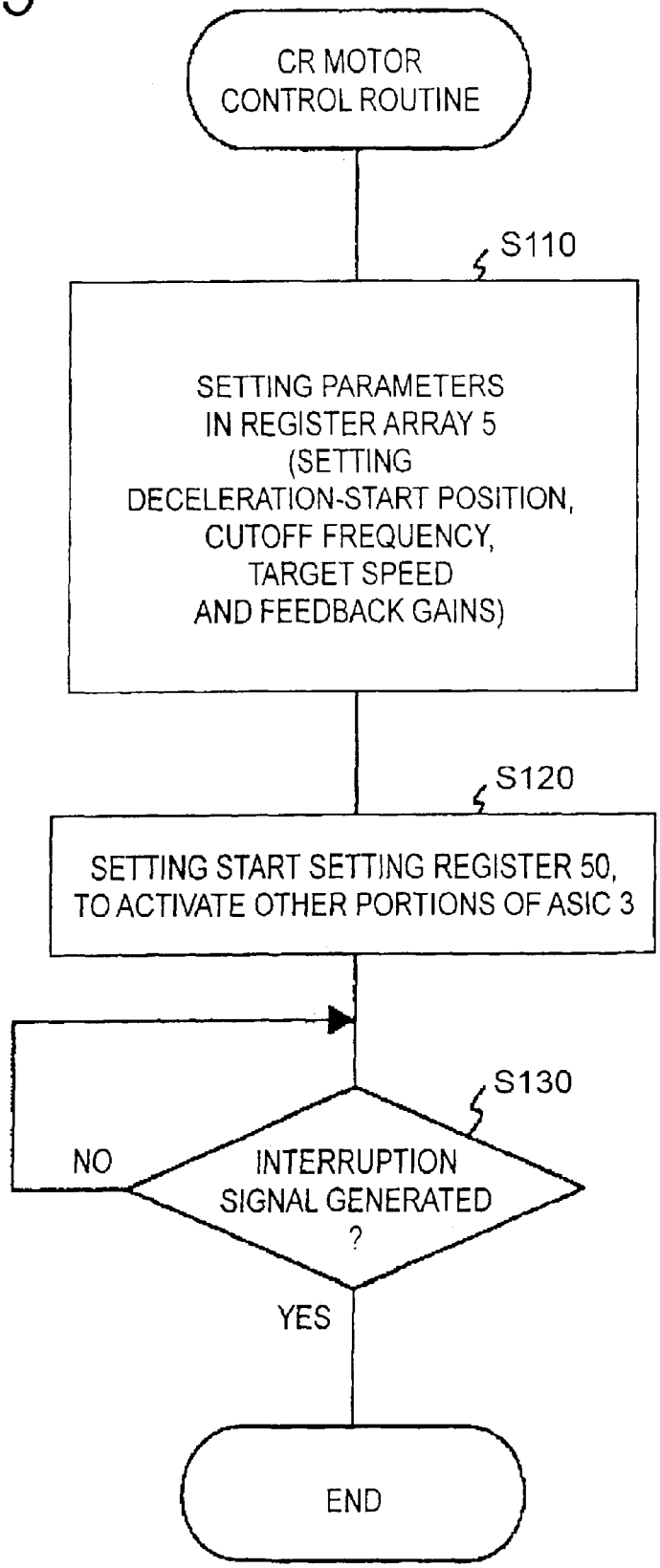
FIG. 5 is a flow chart illustrating a routine executed by a CPU of the carriage motor control apparatus to control the carriage drive motor.

Referring next to the flow chart of FIG. 5, there will be described a CR motor control routine executed by the CPU 2 of the present carriage motor control apparatus 1.

The CR motor control routine is initiated with step S110 to set various parameters in the register array 5 of the ASIC 3, namely, the deceleration-start position in the deceleration-start position register 51, the cutoff frequency in the cutoff-frequency register 52, the target speed in the target-speed register 53, and the differential, integral and proportional gains in the gain register 54. Then, the control flow goes to step S120 to set the start setting register 50, for activating the other portions of the ASIC 3, so that the CR motor 35 is controlled according to the values set in the various registers, to move the carriage 31. When the carriage 31 has reached the deceleration-start position, the interruption signal is generated by the comparator-processor portion 62. Step S120 is followed by step S130 to determine whether the interruption signal has been generated. One cycle of execution of the present CR motor control routine is terminated upon generation of the interruption signal.

In the carriage motor control apparatus 1 constructed as described above, the ASIC 3 is started by the CPU 2 by setting the register array 5, so that the speed control signal generated by the feedback processing portion 70 is applied as the motor control signal to the PWM-signal generating portion 8 until the carriage 31 has reached the deceleration-start position set in the deceleration-start-position register 51. Accordingly, the operating speed (torque) of the CR motor 35 is controlled such that the moving speed of the carriage 31 is controlled to be equal to the target speed set in the target-speed register 53. As a result, the carriage 31 is accelerated in the accelerating region so that the moving speed of the carriage 31 is increased to the target value. In the following constant-speed region, the carriage 31 is moved at the target speed.

When the carriage 31 has reached the deceleration-start position, the comparator-processor portion 62 applies the interruption signal to the CPU 2, while at the same time the motor control signal to be applied to the PWM-signal generating portion 8 is changed from the speed control signal to the deceleration control signal generated by the deceleration control portion 71. As a result, the CR motor 35 is operated as an electric generator with a kinetic energy of the still moving carriage 31, so that a rotary motion of the CR motor 35 is converted into an electric energy, whereby the carriage 31 is efficiently decelerated in the decelerating region from the deceleration-start position, and is eventually stopped.

Figure 6:
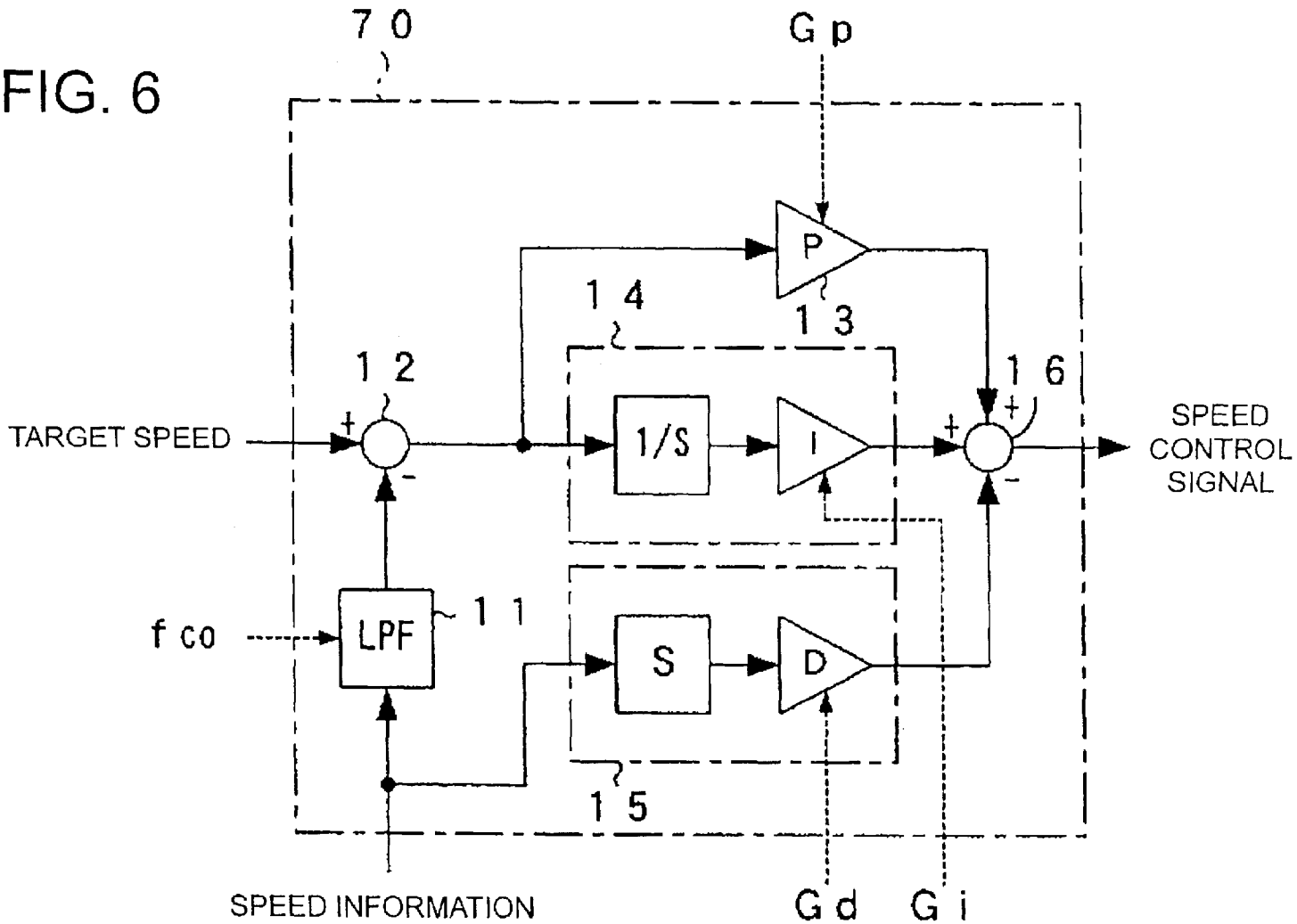
FIG. 6 is a block diagram showing an arrangement of a feedback control portion of the carriage motor control apparatus of FIG. 4.

As shown in FIG. 6, the feedback processing portion 70 arranged to apply the speed control signal as the motor control signal to the PWM-signal generating portion 8 to move the carriage 31 from the zero position to the deceleration-start position includes the above-indicated low-pass filter (LPF) 11, a subtracter 12, a proportional operator 13, an integral operator 14, a differential operator 15 and a final operator 16. The LPF 11 has a cutoff frequency $f_{co}$ determined by the cutoff frequency set in the cutoff-frequency register 52, and is operable to remove, from an original speed signal (hereinafter referred to as "speed information") generated by the speed calculating portion 64, a frequency component higher than the cutoff frequency $f_{co}$. The subtracter 12 is operable to subtract, from the target speed set in the target-speed register 53, a speed represented by a filtered speed signal or the speed information which has passed the LPF 11, so that a speed control error between the target speed and the speed represented by the filtered speed signal is calculated. The proportional operator 13 is operable to calculate a proportional control value by multiplying the speed control error (calculated by the subtracter 12) by the proportional gain Gp set in the gain register 54. The integral operator 14 is operable to integrate the calculated speed control error, and multiply the thus obtained sum by the integral gain Gi set in the gain register 54, to calculate an integral control value. The differential operator 15 is operable to differentiate the speed information which is received from the speed calculating portion 64 and which has not passed the LPF 11, and multiply the thus obtained derivative by the differential gain Gd set in the gain register 54, to calculate a differential control value. The final operator 16 is operable to subtract the differential control value from a sum of the proportional and integral control values, to obtain the speed control signal to be applied to the PWM-signal generating portion 8. Thus, the feedback processing portion 70 is arranged to effect a so-called PID control of pre-differentiation type.

The cutoff frequency $f_{co}$ of the LPF 11 is set according to the target speed, so as to be lower than a cogging frequency at which the cogging of torque of the CR motor 35 takes place when the speed represented by the speed information is equal to the target speed.

The differential operator 15 is arranged to minimize an influence of minute vibrations (of several hundreds of Hz to several kHz) on the moving speed of the carriage 31 and the resolution of an image printed by the printing head 30.

Thus, the carriage motor control apparatus 1 according to the present embodiment is adapted such that the proportional and integral controls of the PID control effected by the feedback processing portion 70 use only a portion or component of the speed information which reflects speed variations at frequency values lower than the cutoff frequency $f_{co}$, while the differential control uses the entire portion of the speed information including a portion which reflects speed variations at frequency values not lower than the cutoff frequency $f_{co}$.

In the present carriage motor control apparatus 1, therefore, the feedback processing portion 70 does not amplify the speed variations which would be otherwise superimposed on the speed information due to the cogging of the torque of the CR motor 35, so that the moving speed of the carriage 31 in the constant-speed region can be controlled with improved stability. Further, the differential operator 15 is arranged to receive a signal component of the speed information which has a frequency not lower than the cogging frequency, so that speed variations due to the minute vibrations can also be effectively minimized, permitting a printing operation with high image resolution.

Figure 7A:
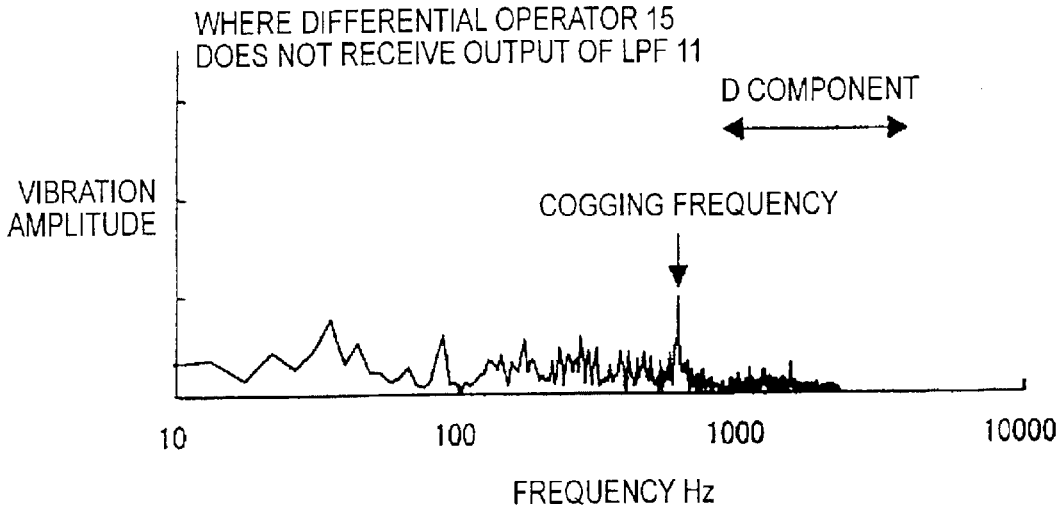
FIGS. 7A and 7B are graphs indicating frequency distributions of signal components of speed information.
Figure 7B:
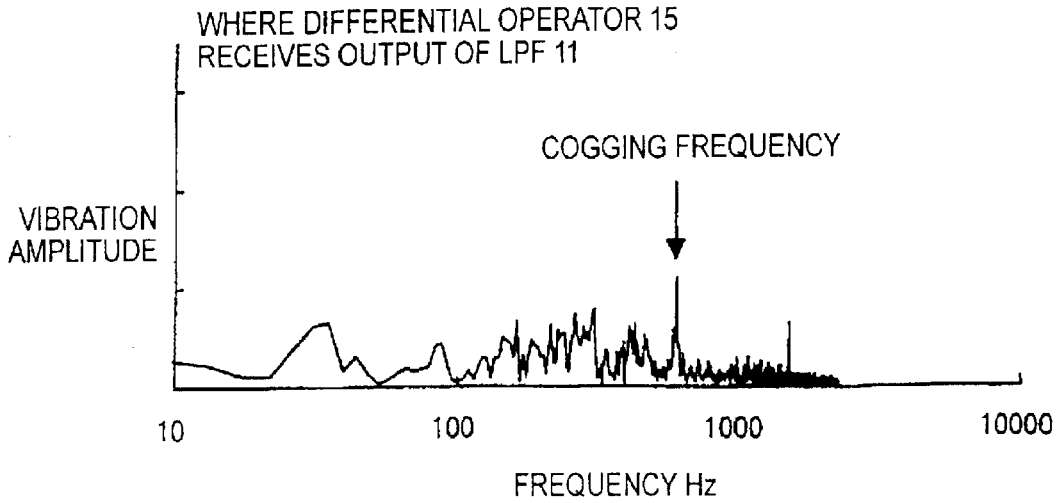

The graph of FIG. 7A shows a measured frequency distribution of signal component of the speed information which is generated by the speed calculating portion 64 and processed by the feedback processing portion 70, while the graph of FIG. 7B shows a measured frequency distribution of the signal component of the speed information not processed by the feedback processing portion 70 but processed by a feedback processing portion wherein the differential operator 15 as well as the proportional and integral operators 13, 14 receives the speed control error (obtained by the subtracter 12 based on the output of the LPF 11). It will be understood from these graphs that the present carriage motor control apparatus 1 is capable of reducing the vibration amplitude over an entire frequency range higher than the cogging frequency, in particular, effectively reducing a peak of the vibration amplitude at a frequency higher than 1000 Hz.

The present carriage motor control apparatus 1 has a further advantage that the cutoff frequency $f_{co}$ of the LPF 11 can be readily changed as desired, by changing the value set in the cutoff-frequency register 52, depending upon the target speed, so that the cutoff frequency $f_{co}$ can be adjusted to suit the target speed.

In the present embodiment, the linear encoder 39, period counter 63 and speed calculating portion 64 cooperate to constitute a speed-signal generating portion operable to generate a moving-speed signal or speed information indicative of the moving speed of the carriage 31, and the feedback processing portion 70 functions as a control-signal generating portion operable to generate the speed control signal to be applied to the control signal selector 72. Further, the subtracter 12, proportional operator 13, integral operator 14 and differential operator 15 respectively function as an error calculator to calculate the speed control error, a proportional operator operable to calculate the proportional control value, an integral operator operable to calculate the integral control value, and a differential operator operable to calculate the differential control value.

<Second Embodiment>

There will be described a carriage motor control apparatus according to a second embodiment of this invention, which is different from the carriage motor control apparatus 1 of the first embodiment, only in the content of the cutoff-frequency register 52 and in the arrangement of the feedback processing portion. Only those aspects of the second embodiment which are different from the first embodiment will be described.

Figure 8:
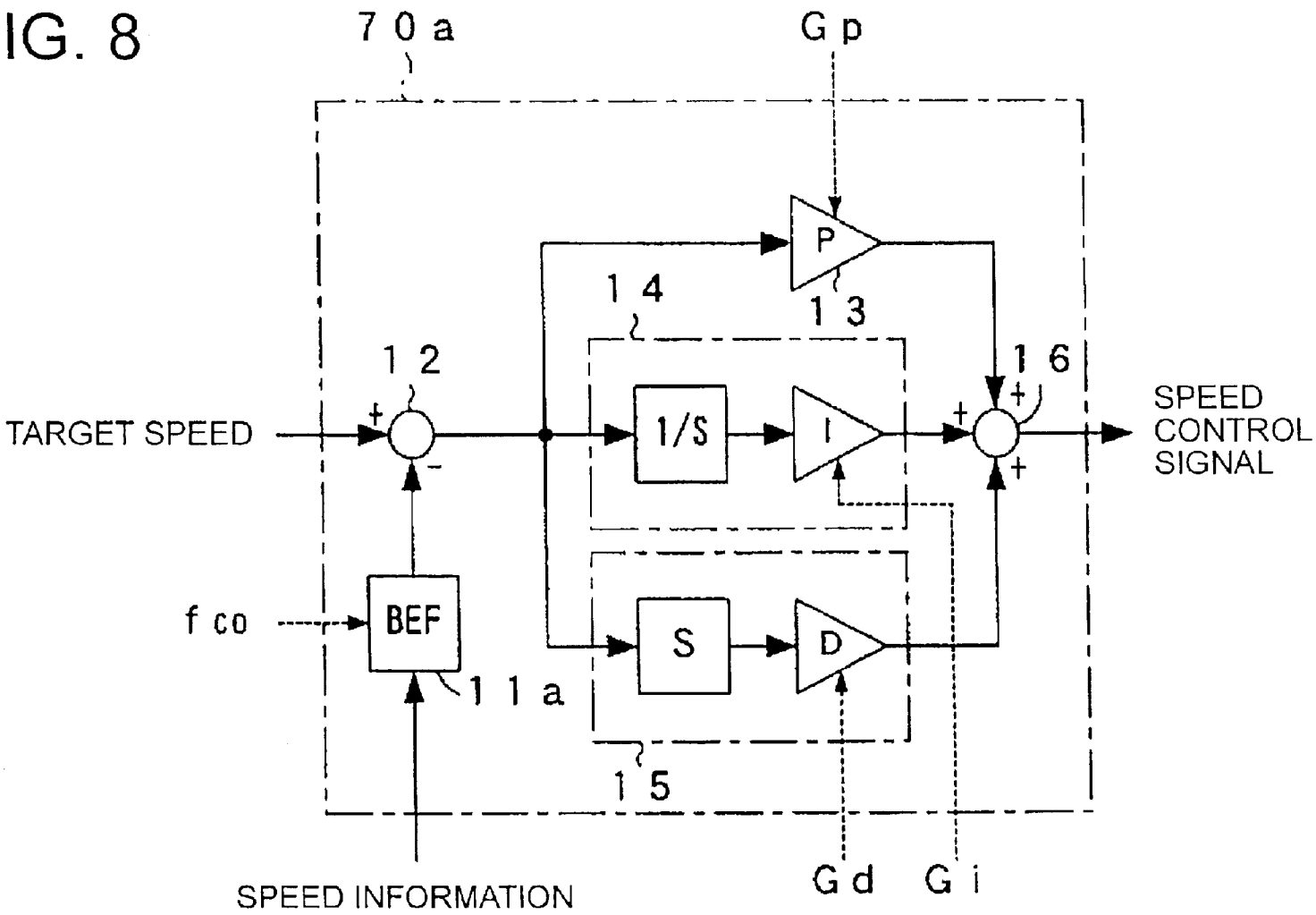
FIG. 8 is a block diagram showing an arrangement of a feedback control portion of a carriage motor control apparatus according to a second embodiment of this invention.

That is, the carriage motor control apparatus of the second embodiment includes a feedback processing portion 70*a* which includes a band elimination filter (BEF) 11*a*, in place of the LPF 11, as shown in FIG. 8. The cutoff-frequency register 52 stores two cutoff frequency values which define respective upper and lower limits of a cutoff frequency band. The BEF 11*a* is arranged to remove, from the original speed information generated by the speed calculating portion, a frequency component within the cutoff frequency band defined by the above-indicated upper and lower limits. Further, the differential operator 15 as well as the proportional and integral operators 13, 14 receive as its input the speed control error calculated by the subtracter 12.

Like the cutoff frequency $f_{co}$ used in the first embodiment, the cutoff frequency band defined by the values set in the cutoff-frequency register 52 is changed according to the target speed, and is determined to include the cogging frequency of the CR motor 35 when the moving speed of the carriage 31 represented by the speed information is equal to the target speed.

In the carriage motor control apparatus constructed as described above according to the second embodiment of the present invention, the filtered speed signal obtained by removing from the original speed information the frequency component within the cutoff frequency band near the cogging frequency of the CR motor 35 is used by the feedback processing portion 70*a*, so that the speed variations which would be otherwise superimposed on the speed information due to the cogging of the torque of the CR motor 35 are not amplified by the feedback processing portion 70*a*. Further, the differential operator 15 receives a signal component of the speed information which has a frequency not lower than the cogging frequency. Accordingly, the carriage motor control apparatus of the second embodiment has substantially the same advantages as the carriage motor control apparatus 1 of the first embodiment.

The BEF 11*a* in the present second embodiment functions as a filter operable to remove a signal component corresponding to the cogging frequency of the CR motor 35, from the original speed signal generated by the speed calculating portion 64.

<Third Embodiment>

There will be described a carriage motor control apparatus according to a third embodiment of this invention, which is different from the carriage motor control apparatus 1 of the first embodiment, only in the register array and a part of the feedback processing portion.

Figure 9:
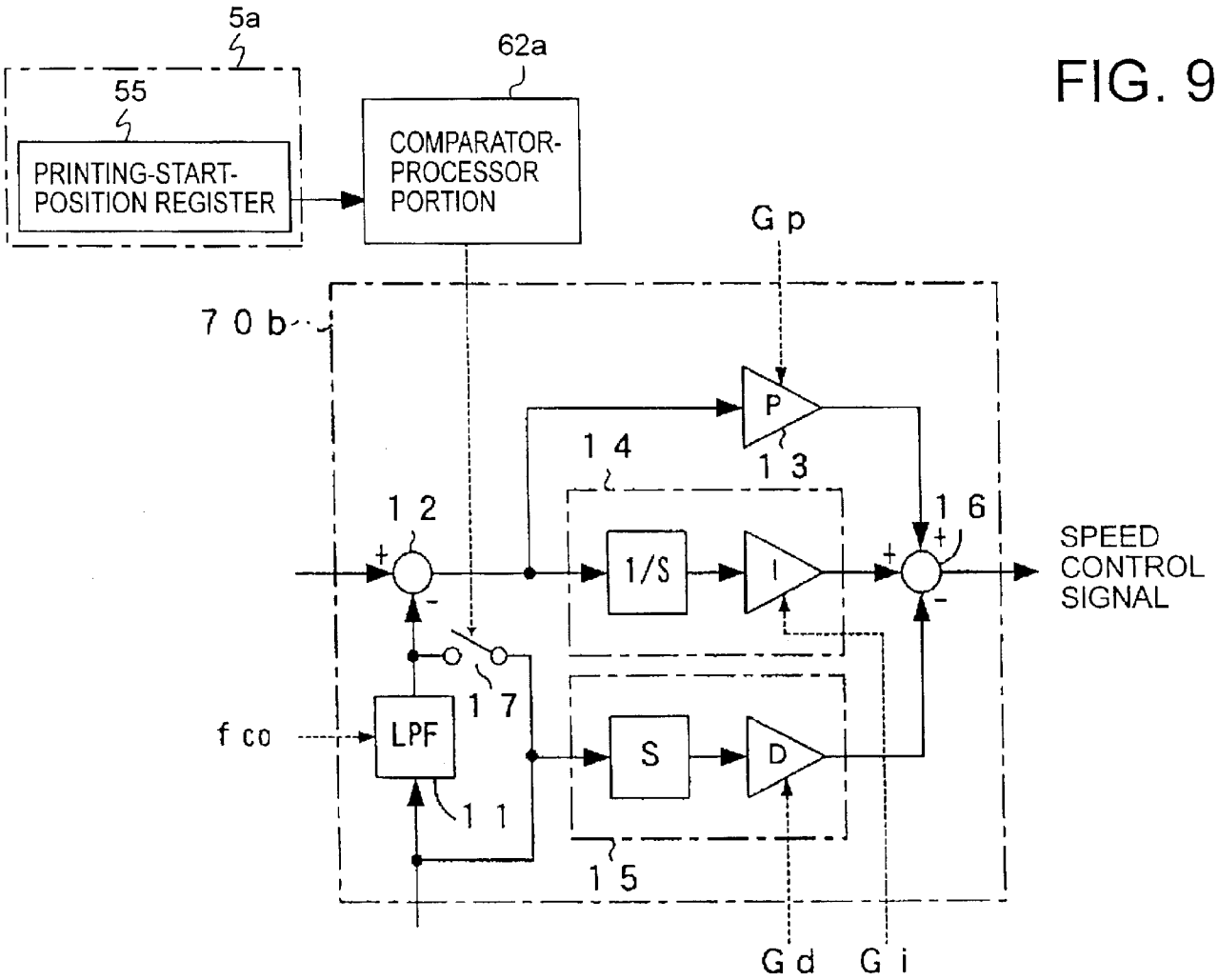
FIG. 9 is a block diagram showing an arrangement of a feedback control portion and its vicinity of a carriage motor control apparatus according to a third embodiment of this invention.

That is, the carriage motor control apparatus of the third embodiment includes a register array 5*a* which includes a printing-start-position register 55, as shown in FIG. 9, in addition to the registers 50–54. The printing-start-position register 55 stores data indicative of the printing-start position, namely, the acceleration-end position. This printing-start-position register 55 as well as the deceleration-start-position register 51 are connected to a comparator-processor portion 62*a* of the carriage detecting portion 6. The comparator-processor portion 62*a* compares the count of the position counter 61 with not only the value of the deceleration-start-position register 51, to generate a control switching signal (second control switching signal) as in the first embodiment, but also the value of the printing-start register 55, to generate a first control switching signal when the carriage 31 has reached the printing-start position.

The third embodiment uses a feedback processing portion 70*b* wherein a by-pass line provided with a switch 17 is connected to the speed calculating portion 64 and the subtracter 12, while by-passing the LPF 11. The switch 17 is held in its closed state before the first control switching signal is generated by the comparator-processor portion 62*a*, and is opened when the first control switch signal is generated by the comparator-processor portion 62*a*. This switch 17 and the comparator-processor portion 62*a* function as a signal switching means for changing the signal to be applied to the subtracter 12.

In the present carriage motor control apparatus of the present third embodiment, the feedback processing portion 70*b* performs the PID feedback control during the accelerating movement of the carriage 31, on the basis of the speed information which is generated by the speed calculating portion 64 and which has not passed the LPF 11. After the carriage 31 has reached the printing-start position, that is, during the constant-speed movement of the carriage 31, the feedback processing portion 70*b* performs the PID feedback control in the same manner as in the first embodiment. Accordingly, the present third embodiment has the same advantages as the first embodiment.

In addition, the third embodiment is arranged such that a change in the moving speed of the carriage 31 is more positively fed back in the accelerating region than in the constant-speed region, so as to prevent an excessively high rate of change of the moving speed in the accelerating region.

Accordingly, the carriage motor control apparatus according to the third embodiment makes it possible to prevent damping in the accelerating period, or an overshoot of the moving speed upon a movement of the carriage 31 from the accelerating region into the constant-speed region, assuring a further improvement in the stability of movement of the carriage 31.

While the several preferred embodiments of the present invention have been described above, it is to be understood that the invention is not limited to the details of the illustrated embodiments, but may be embodied with various changes or modifications, which may occur to those skilled in the art, without departing from the spirit of the present invention.

In the illustrated embodiments, the cutoff frequency $f_{co}$ and the target speed are both set by the operator. However, the cutoff frequency $f_{co}$ may be automatically calculated depending upon the target speed and automatically set in the cutoff-frequency register 52 when the target speed is manually set in the target-speed register 53.

Although the CR motor 35 provided in the illustrated embodiments is a DC motor, the electric motor to be controlled by the carriage motor control apparatus according to the present invention may be any type of motor such as a stepping motor, as long as the motor has a non-linear relationship between the amount of control and the torque (operating speed).

In the illustrated embodiments, the ASIC 3 is used to calculate the moving speed and position of the carriage 31 and generate the PWM signal for controlling the operating speed of the CR motor 35. However, the ASIC 3 may be replaced by a programmable logic device such as CPLD (Complex Programmable Logic Device) and FPGA (Field Programmable Gate Array).

What is claimed is:

1. A method of controlling an operating speed of a motor provided to move an object body such that a moving speed of said object body coincides with a predetermined target value, comprising the steps of:

obtaining a speed control error between said target value and a speed value represented by a filtered speed signal obtained by removing a component having a frequency not lower than a predetermined threshold value, from an original speed signal corresponding to said moving speed of said object body; and controlling said operating speed of said motor according to a control signal generated on the basis of results of a proportional calculating operation and an integral calculating operation of said speed control error, and a result of a differential calculating operation of said original speed signal.

2. A method according to claim 1, wherein said predetermined threshold value is not higher than a cogging frequency of said motor.

3. A method according to claim 1, wherein said object body is a carriage which carries a printing head.

4. A method according to claim 1, wherein said control signal is generated by subtracting the result of said differential calculating operation from a sum of the results of said proportional and integral calculating operations.

5. A method according to claim 1, wherein said operating speed of said motor is controlled according to said control signal until said object body has reached a predetermined deceleration-start position at which deceleration of said object body is initiated.

6. A method according to claim 1, wherein said operating speed of said motor is controlled according to said control signal while said object body is moved between a predetermined acceleration-end position and a predetermined deceleration-start position at which acceleration and deceleration of said object body are terminated and initiated, respectively.

7. A method according to claim 1, wherein said predetermined threshold value is changed depending upon said target value of said operating speed of said object body.

8. A motor control apparatus for controlling an operating speed of a motor provided to move an object body, said motor control apparatus including a speed-signal generating portion operable to generate a speed signal corresponding to a moving speed of said object body, and a control-signal generating portion operable to generate a control signal for controlling the operating speed of said motor such that the moving speed of said object body represented by said speed signal coincides with a predetermined target value, said control-signal generating portion comprising:

a filter operable to remove from said speed signal a component which has a frequency not lower than a predetermined threshold value;

an error calculator operable to obtain a speed control error between a speed represented by an output of said filter and said target value;

a proportional operator operable to obtain a proportional control value proportional to said speed control error;

an integral operator operable to obtain an integral control value proportional to an integral of said speed control error;

a differential operator operable to obtain a differential control value proportional to a derivative of said speed signal; and an arithmetic operator operable to generate said control signal on the basis of said proportional, integral and differential control values.

9. A motor control apparatus according to claim 8, wherein said predetermined threshold value is not higher than a cogging frequency of said motor.

10. A motor control apparatus according to claim 8, wherein said object body is a carriage which carries a printing head.

11. A motor control apparatus according to claim 8, wherein said predetermined threshold value of said filter is variable depending upon said target value.

12. A motor control apparatus according to claim 8, further including:

a position detector operable to detect a position of said object body; and signal switching means for applying said output of said filter to said error calculator while the position of said object body detected by said position detector is within a predetermined constant-speed region in which the moving speed of said object body is held constant at said target value, and for applying to said error calculator said speed signal generated by said speed-signal generating portion, while the position of said object body is within one of accelerating and decelerating regions in which said object body is accelerated and decelerated, respectively.

13. A motor control apparatus according to claim 8, wherein said arithmetic operator receives said output of said filter until said object has reached a predetermined deceleration-start position at which deceleration of said object body is initiated.

14. A motor control apparatus according to claim 8, wherein said arithmetic operator generates said control signal by subtracting said differential control value from a sum of said proportional and integral control values.

15. A motor control apparatus according to claim 8, further comprising a register which stores data indicative of said predetermined threshold value and which is connected to said filter.

16. A method of controlling an operating speed of a motor provided to move a carriage carrying a printing head, such that a moving speed of said carriage coincides with a predetermined target value, comprising the steps of:

obtaining a speed control error between said target value and a speed value represented by a filtered speed signal obtained by removing at least a component corresponding to a cogging frequency of said motor, from an original speed signal corresponding to said moving speed of said carriage; and controlling said operating speed of said motor according to a control signal generated on the basis of results of a proportional calculating operation, an integral calculating operation and a differential calculating operation of said speed control error.

17. A method according to claim 16, wherein said component corresponding to said cogging frequency of said motor is a frequency component of said original speed signal, which frequency component is within a predetermined frequency band including said cogging frequency.

18. A method according to claim 16, wherein said control signal is generated by summing the results of said proportional, integral and differential calculating operations.

19. A method according to claim 16, wherein said operating speed of said motor is controlled according to said control signal until said carriage has reached a predetermined deceleration-start position at which deceleration of said carriage is initiated.

20. A method according to claim 16, wherein in that said predetermined threshold value is changed depending upon said target value of said operating speed of said carriage.

21. A motor control apparatus for controlling an operating speed of a motor provided to move a carriage carrying a printing head, said motor control apparatus including a speed-signal generating portion operable to generate a speed signal corresponding to a moving speed of said carriage, and a control-signal generating portion operable to generate a control signal for controlling the operating speed of said motor such that the moving speed of said carriage represented by said speed signal coincides with a predetermined target value, said control-signal generating portion comprising:

a filter operable to remove from said speed signal at least a component corresponding to a cogging frequency of said motor;

an error calculator operable to obtain a speed control error between a speed represented by an output of said filter and said target value;

a proportional operator operable to obtain a proportional control value proportional to said speed control error;

an integral operator operable to obtain an integral control value proportional to an integral of said speed control error;

a differential operator operable to obtain a differential control value proportional to a derivative of said speed control error; and an arithmetic operator operable to generate said control signal on the basis of said proportional, integral and differential control values.

22. A motor control apparatus according to claim 21, wherein said arithmetic operator receives said output of said filter until said object has reached a predetermined deceleration-start position at which deceleration of said object body is initiated.

23. A motor control apparatus according to claims 21, wherein said arithmetic operator generates said control signal by summing said proportional, integral and differential control values.

24. A motor control apparatus according to claim 21, further comprising a register which stores data indicative of said predetermined threshold value and which is connected to said filter.

* * * * *